US005863188A

United States Patent [19]

Dosman

[11] Patent Number: 5,863,188

[45] Date of Patent: Jan. 26, 1999

[54] FLUID FLOW REDUCER

[76] Inventor: James A. Dosman, 1810 Cherry Rd., Springfield, Ill. 62704

[21] Appl. No.: 712,546

[22] Filed: Sep. 11, 1996

Related U.S. Application Data

[60] Provisional application No. 60/021,248 Jul. 12, 1996.

[51] Int. Cl.[6] ..... F04B 17/00

[52] U.S. Cl. ..... 417/391; 417/404

[58] Field of Search ..... 60/419, 325; 417/391, 417/404, 406

[56] References Cited

U.S. PATENT DOCUMENTS

| | | | |
|---|---|---|---|
| 2,042,533 | 6/1936 | Kieser . | |
| 2,888,802 | 6/1959 | Dosmann . | |
| 3,077,074 | 2/1963 | Collman et al. | 417/409 |
| 3,826,594 | 7/1974 | Hornschuch et al. | 417/409 X |
| 4,086,760 | 5/1978 | Chute | 417/406 X |
| 4,264,285 | 4/1981 | Erickson et al. . | |
| 4,712,984 | 12/1987 | Lepert | 417/391 |
| 4,769,987 | 9/1988 | Arold | 60/325 |
| 4,865,529 | 9/1989 | Sutton et al. | 417/409 |
| 5,049,045 | 9/1991 | Oklejas et al. . | |
| 5,588,813 | 12/1996 | Berke-Jorgensen | 417/391 |

*Primary Examiner*—Hoang Nguyen
*Attorney, Agent, or Firm*—Richard C. Litman

[57] ABSTRACT

A fluid flow reducing unit is incorporated in various mechanical systems to increase the mechanical advantage without the addition of energy. The fluids gaseous, liquid or mixtures thereof, are processed by the fluid flow reducing unit to increase the pressure of the effluent fluids when a higher pressure load is applied. The fluid flow reducing system can be employed in rockets, gas turbines, pump and motor systems, fire engine pumper water lines, blood pressure systems, steam engines, etc. An 'Unidentified Flying Object-UFO' requires a Fluid Power Transmission to produce higher gas pressure for very rapid acceleration. The statement by Archimedes—'Give me a fulcrum on which to rest and I will move the earth.' relates to the application of a physical mechanical force on a lever arm. The application of a physical fluid pressure on a lever arm also does exist in the form of a Fluid Power Transmission means for greater thrust propulsion.

6 Claims, 8 Drawing Sheets

FLUID FLOW REDUCER

This application includes subject matter first advanced in the abandoned application, Ser. No. 789,749 filed Jan. 28, 1959, which was a continuation-in-part of U.S. Pat. No. 2,888,802, issued on Jun. 2, 1959. This application is based on the Provisional Patent Application, Ser. No. 60/021,248, filed on Jul. 12, 1996.

BACKGROUND OF THE INVENTION

1. Field of the Invention

The present invention relates to an improvement of mechanical systems involving the flow of fluids, gas, liquids or mixtures thereof, wherein a mechanical advantage is obtained by reducing the fluid flow within an incorporated fluid flow reducer device and increasing the fluid pressure without the addition of energy. For example, the fluid power output of a conventional gas turbine engine is in the form of a high gas flow, but with a relatively low gas pressure. The present gas flow reducing unit reduces the high flow of gas, but will increase the low pressure only when a higher pressure load of gas is required. In particular, the mechanical systems improved by this device include a turbine and compressor system and a motor and pump system. Other modifications include the additions of a fixed or variable gear reduction unit, a bleed-off or by-pass unit, and an axial flow compressor.

2. Description of the Prior Art

The prior art describes mechanical systems which do not. emphasize the mechanical advantage gained by a reduction in the fluid flow system. The prior art will be discussed in the order of their perceived relevance to the present invention.

U.S. Pat. No. 2,888,802 issued on Jun. 2, 1959, to James A. Dosmann describes a vehicle turbine power system comprising a compression means, an air conduit means, a combustion means, a fluid flow energy transfer means, a fluid flow reducer means, a fluid driven mechanical transmission means, a heat exchange means, a fluid flow exhaust means, and a power induction means. The fluid flow reducer means consists of an impeller means, a rotor shaft, a turbine means, and a fluid flow casing means. The fluid flow reducer means in this disclosure begins with the mixed gases flowing through the impeller means to the turbine means. This arrangement of the impeller and turbine is reversed in the present invention with the addition of other modifications. The present invention is not concerned with a gas turbine, per se, but with other applications which handle gases, liquids and mixtures thereof.

U.S. Pat. No. 5,049,045 issued on Sep. 17, 1991, to Robert A. Oklejas et al. describes a power recovery turbine pump useful in a reverse osmosis process for the desalination of sea water. The turbine impeller and a pump impeller are positioned on the same shaft. The pump impeller is caused to rotate by the rotation of the turbine impeller. The pump impeller raises the pressure of the fluid passed to the pump outlet. The object of this invention is to recover power that would normally be wasted from a pressurized fluid source. The object of the present invention is to increase the mechanical efficiency of the fluid by reducing the fluid flow. The patent teaches against the reduction of fluid flow by added means such as a fixed and variable transmission. The application of this invention is limited to liquid systems, whereas the present invention can be applied to gases, liquids and mixtures thereof.

U.S. Pat. No. 4,264,285 issued on Apr. 28, 1981, to John W. Erickson describes a downhole cleaner assembly for cleansing lubricant of downhole turbo-machines within wells. The turbo-machines are comprised of several stages of turbines and pumps assembled on a common shaft for increasing the fluid pressure. The bleeding of lubricant from the journals and journal bearings into the fluid stream passing through the turbine pumps cannot be tolerated in the present invention.

U.S. Pat. No. 2,042,533 issued on Jun. 2, 1936, to Walter Kieser describes rotary pumps or compressors driven by an elastic fluid turbine having a rotor fastened to the shaft of the compressor. Again, the mechanical apparatuses are reversed in position as to the fluid flow from that in the present invention.

None of the above inventions and patents, taken either singly or in combination, is seen to describe the instant invention as claimed.

SUMMARY OF THE INVENTION

Accordingly, it is a principal object of the invention to provide an improvement in a mechanical fluid system wherein a mechanical advantage is obtained by employing a fluid flow reducer element to reduce the fluid flow and increase the effluent pressure.

It is another object of the invention to improve a gaseous flow turbine and compressor system by incorporating a fluid flow reducer element.

It is a further object of the invention to improve a liquid processing motor and pump system to include a fluid flow reducer element.

Still another object of the invention is to improve either gaseous fluid processing turbine-compressor systems or liquid processing motor and pump systems to further include a variable gear reduction unit and/or a by-pass conduit which can include a ring valve.

Yet another object of the invention is to provide a gas turbine and an axial flow compressor system with a gear reduction unit.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention provides a mechanical advantage to any mechanism system involving the flow of fluids i.e., gaseous, liquid or mixtures thereof. Exemplary examples of the application of this invention include the following: Energy sources such as solar, nuclear, coal, gas, and oil which produce steam for steam turbine energy that drives an electric power generator; an energy source such as a hydroelectric dam which utilizes water flow through a turbine which drives an electrical power generator; oil and natural gas transmission pipe lines; heat pumps and air conditioning systems; hydraulic and pneumatic systems; fire engine pumper lines; heart assisting pumps; missiles and rockets; and vehicles such as automobiles, boats, jet crafts, and ships. The size of the present inventive apparatus can vary from a mechanism small enough to be inserted in a human body or as large as to be incorporated in a jet engine or a large rocket.

The fluid flow reducing principle is applied first to two main systems, i.e., turbine and compressor systems for gases and pump and motor systems for liquids. Secondly, each system can have a fixed mechanical gear reduction unit to provide a mechanical advantage with lower shaft speed but greater shaft torque between either the turbine and compressor or the motor and the pump for a greater fluid pressure load. Thirdly, each system can have in addition a modified conventional mechanical transmission to provide variable shaft speeds between the turbine and the compressor or the motor and the pump for a required variable fluid pressure load. Finally, a fluid by-pass feature serves to provide a direct fluid flow for a lower fluid pressure load. This by-pass feature is equivalent to the "Direct Drive" or "Overdrive" for an automobile.

Figure 1:
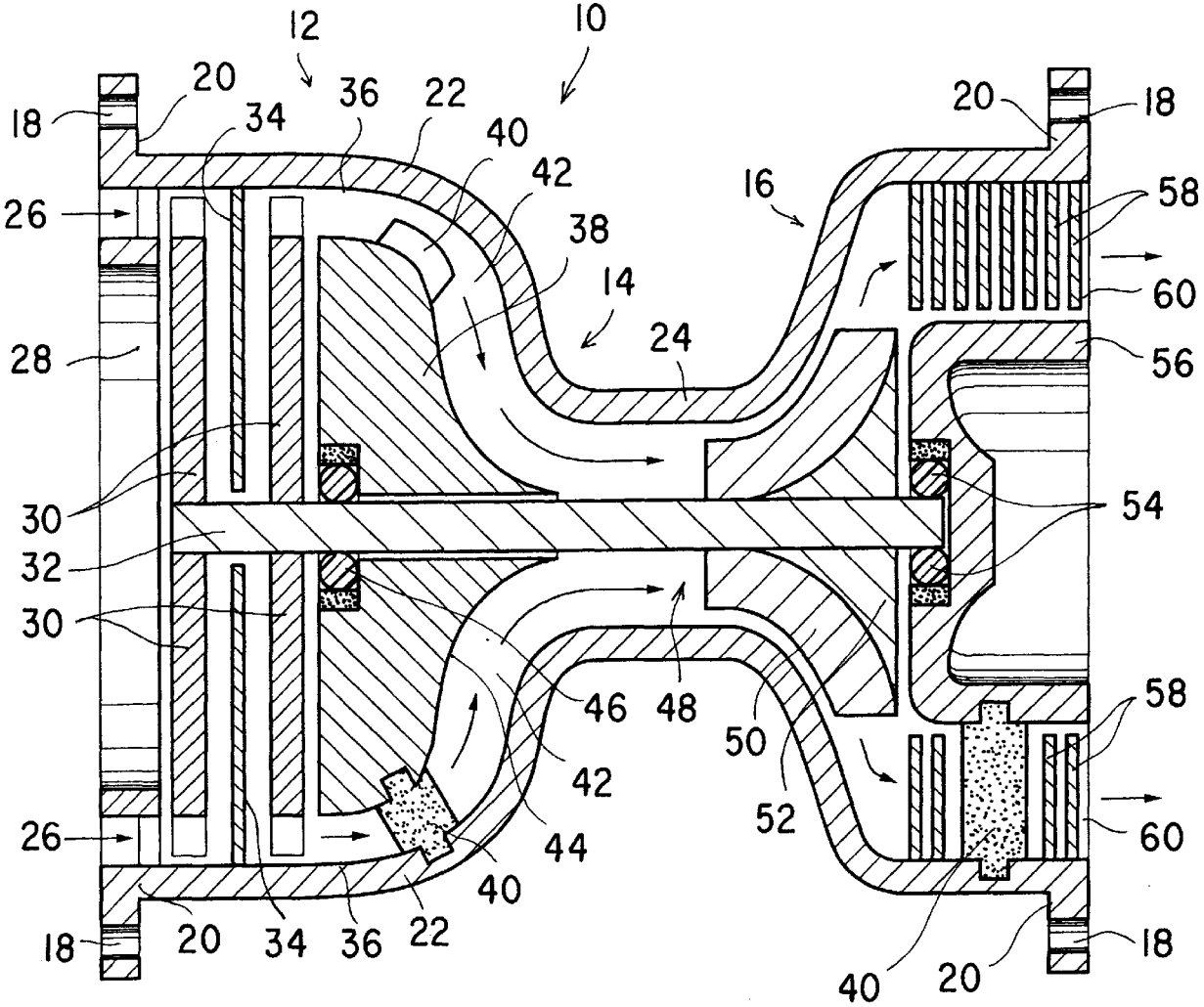
FIG. 1 is a cross-sectional view of a first embodiment of a gas turbine and compressor system including a fluid flow reducing unit.

FIG. 1 is directed to the first embodiment of a turbine and compressor system 10 for gaseous fluids including steam, and includes the turbine portion 12, the fluid flow reducing unit 14 and the compressor portion 16. Bolt holes 18 are provided at the peripheral flanges 20 at both ends of the turbine and compressor system 10 for connection within other systems. The outer cylindrical casing 22 has a necked portion 24 which constitutes the fluid flow reducing unit 14. In the first embodiment of FIG. 1, gas flow direction is shown by arrows. At the fluid inlet region 26, a cylindrical shroud band 28 directs the gas entering the fluid inlet region 26 to the rotor blades 30 which are connected to the drive shaft 32. The rotor blades 30 are depicted in a partial section at a point proximate to the round tip. Although only four rotor blades are shown in partial section, it is understood that the rotor blades 30 are more numerous and are spaced in a slightly helical manner individually on the drive shaft similar to a multi-bladed room fan or a propeller. Similarly, the turbine stator blades 34 are arranged in a slightly helical manner individually and fixed to the inside surface 36 of the outer cylindrical casing 22. There is adequate spacing between the stator blades 34 and the rotor blades 30 to permit the passage of the fluid through this assembly of rotor blades and stator blades, and the passage of the moving rotor blades through the fixed stator blades. A turbine support casing 38 is fixed also to the inside surface 36 by struts 40 placed at several locations equidistant from each other.

A critical feature of the turbine portion 12 is the channel 42 defined by the inside surface 36 of casing 22 and outer surface 44 of the turbine support casing 38 enlarges as the channel 42 approaches the necked portion 24.

Within the turbine support casing 38, bearings 46 permit the rotation of the turbine drive shaft 32. Proximate to the opposite end of the drive shaft, an impeller 48 is fixed to the shaft. The impeller 48 has multiple vanes 50 spaced equidistantly and extending in a slightly helical manner from a thicker base portion 52 to increase the rotation of the drive shaft 32. The opposite end is supported by bearings 54 embedded in the impeller support casing 56. This casing is similarly supported by equidistantly spaced struts 40 affixed to the inside surface 36 of the outer cylindrical casing 22.

The impeller support casing 56 and the impeller 48 have the same diameter which is smaller than the diameter of the turbine rotor blades 30 and the turbine support casing 38 to provide the mechanical advantage. Since the radii of the turbine stator blades 34 are relatively larger than the largest radii of the impeller 48, a mechanical advantage is gained and different speeds of rotation are obtained. The difference in rotational speed is based on the fluid particles at the tips of the turbine rotor blades 30 and the compressor impeller vanes 50. An analogous situation would be on a carousel wherein two people are positioned at different distances from the center of a rotating carousel. The person closer to the center of the carousel is travelling at a slower speed than the person at the periphery of the carousel.

In the enlarged space between the impeller support casing 56 and the inside surface 36 of the outer cylindrical casing 22, up to 20 stator blades 58 are positioned in a slightly helical manner individually and spaced equidistantly from each other. The helical direction of the turbine rotor blades 30, the turbine stator blades 34, the impeller vanes 50, and the compressor stator blades 58 are all in the same direction. The reduced flow of fluid now at the outlet 60 has an increased pressure without the addition of energy to the mechanical system when a higher pressure load is applied. Thus, a direct mechanical advantage has been obtained by passing the fluid through this turbine and compression system 10 employing the fluid flow reducer unit 14.

Figure 2:
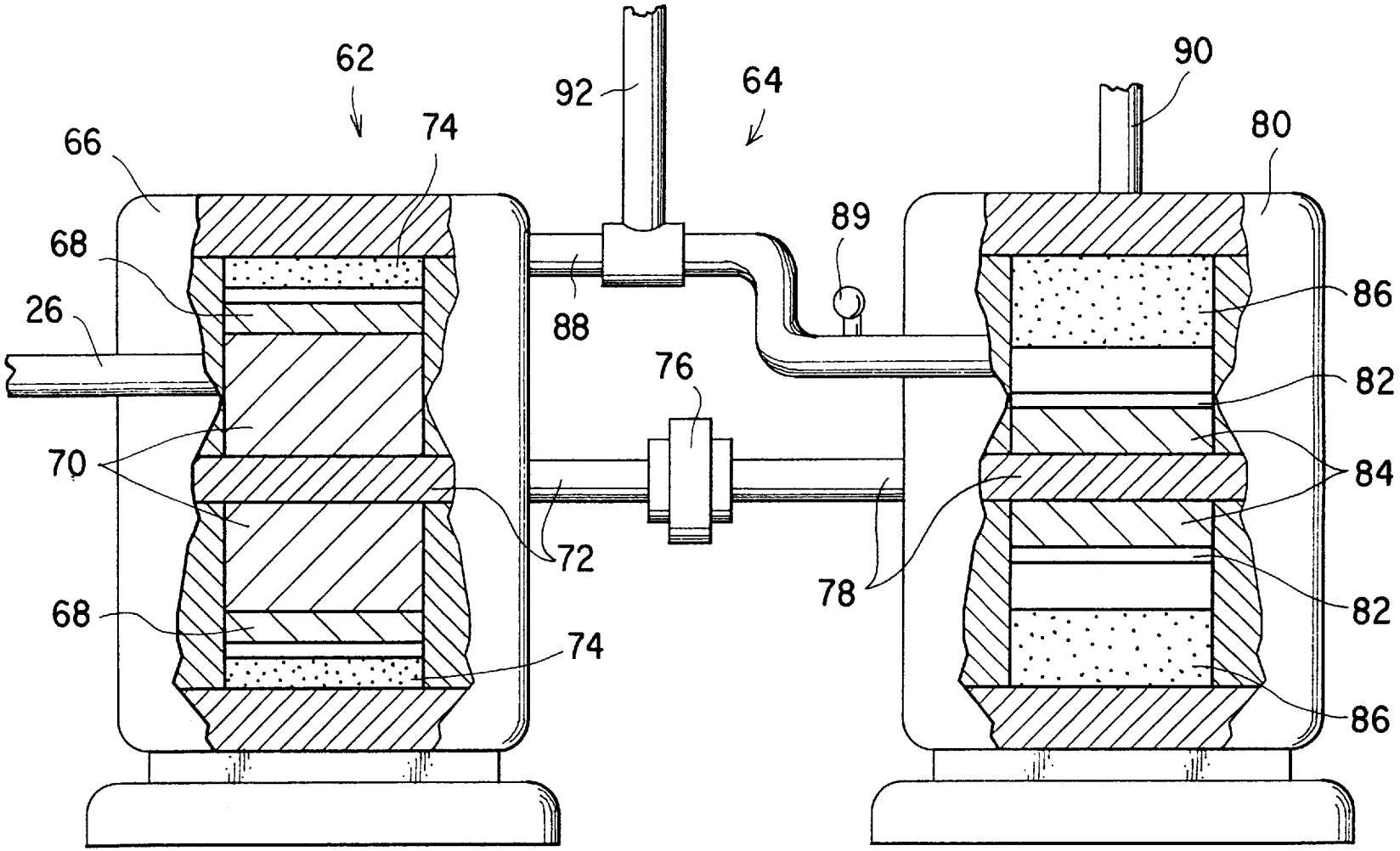
FIG. 2 is a partial cross-sectional view of a second embodiment of a motor and pump system for liquids including a fluid flow reducing unit.

FIG. 2 is directed to a second embodiment wherein a fluid flow reducer unit 62 is incorporated in a motor and pump system 64. The motor element 66 has a fluid (liquid) inlet region 26. The liquid passes through the motor rotor vanes 68 mounted on the motor rotor base 70, which motor element 66 rotates the motor drive shaft 72. A part of the inner space is occupied by a motor ring insert 74. The motor drive shaft 72 is joined by coupling 76 to the pump drive shaft 78 of the pump element 80. The pump element has pump rotor vanes 82 having half the size in diameter of the motor rotor vanes 68. The pump rotor vanes 82 are mounted on a pump rotor base 84 having half the diameter of the motor rotor base 70. The larger inside space must be taken up by a thicker pump ring insert 86 to maintain a liquid volume which varies inversely or is approximately one-half that of the liquid volume in the motor element 66. The liquid passes out from the motor element 66 through the fluid conduit 88 into the pump element 80. A pressure check valve 89 is located in the fluid conduit 88 before the fluid pump inlet to prevent a back up of the fluid flow. The liquid from the pump element issues from the fluid outlet conduit 90.

Because of the increased pressure, a bleed-off conduit or by-pass 92 is provided between the motor element 66 and the pump element 80 in the fluid conduit 88 for controlling excessive fluid pressure in the system.

Thus, a mechanical advantage is gained in the motor and pump system 64 provided by the larger rotor radius of the fluid motor element 66 compared to that of the fluid pump element 80. Consequently, the fluid output pressure has been aggressively increased over that of the fluid inlet pressure.

Figure 3:
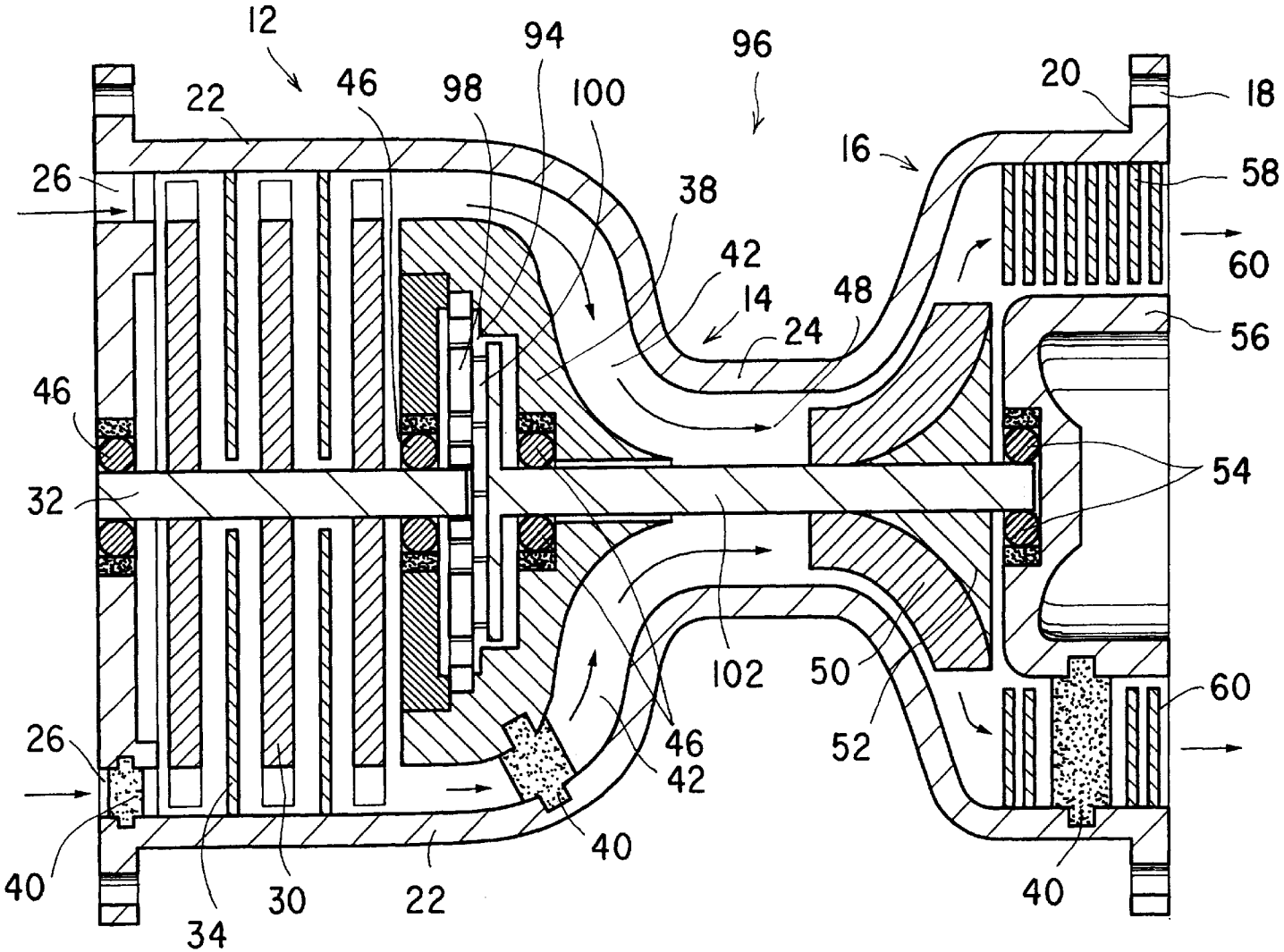
FIG. 3 is a cross-sectional view of a third embodiment of a gas turbine and compressor system including a planetary gear reduction unit and a fluid flow reducing unit.

Turning to the third embodiment of FIG. 3, a planetary gear reduction unit 94 has been incorporated into the gaseous turbine and compressor system 96. Therefore, similar reference characters denoting corresponding features of the apparatus will be utilized without further explanation. The planetary gear reduction unit 94 is conventional with two planetary gears 98 and 100 encased in the turbine support casing 38. The turbine drive shaft 32 is coupled to the upstream planetary gear 98 and rotated with bearings 46. The second downstream planetary gear 100 is coupled to one end of the impeller drive shaft 102 which is supported within the turbine support casing 38 with a bearing 46 and within the impeller support casing 56 with another bearing 54. The reduction in volume in the turbine channel 42 coupled with the reduced rotation rate of the impeller 48 creates the mechanical advantage of increased liquid fluid pressure in the outlet conduit 90 of FIG. 2 when a higher pressure load is applied.

Figure 4:
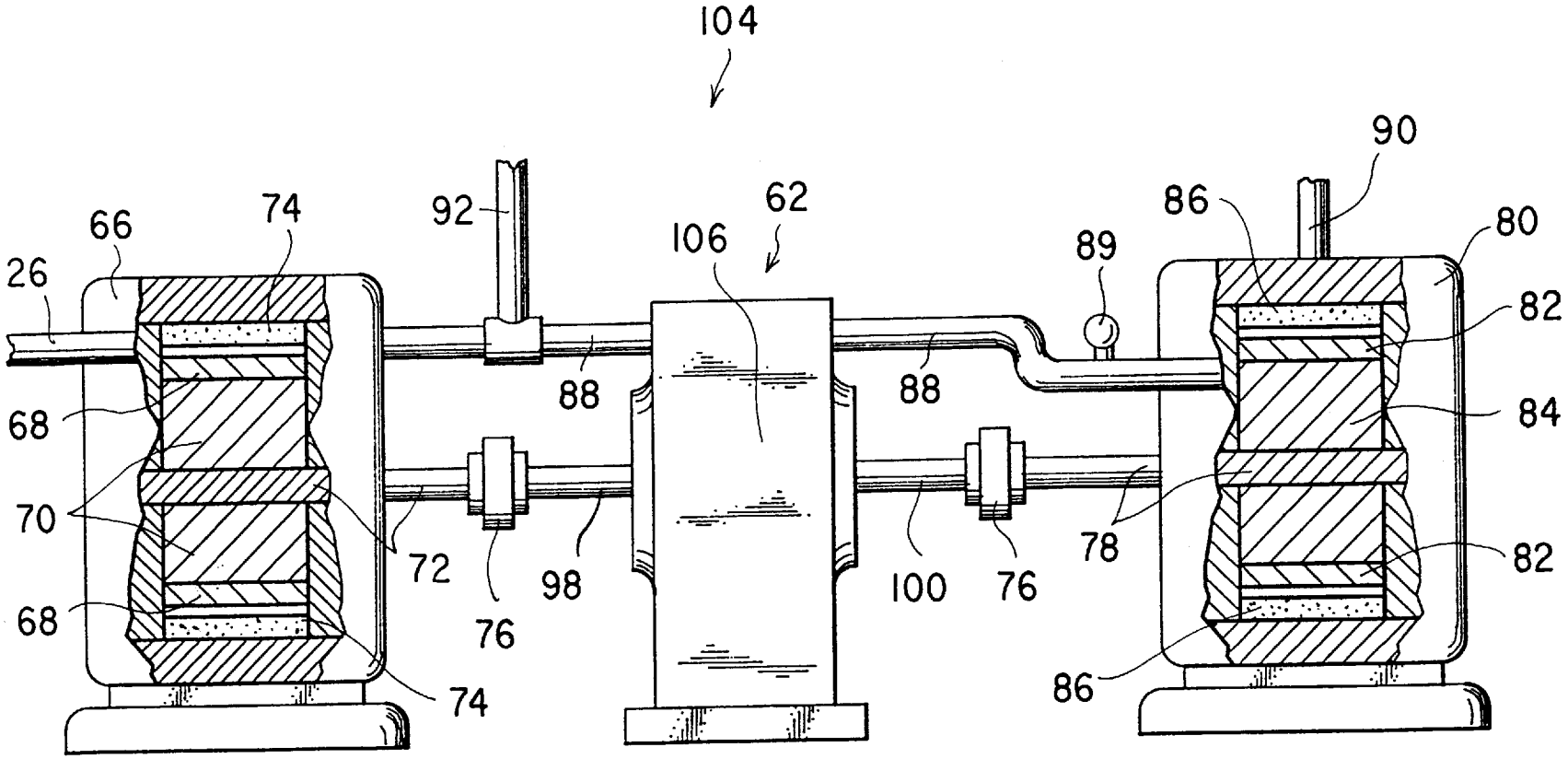
FIG. 4 is a partial cross-sectional view of a fourth embodiment of a motor and pump system for liquids including a fluid flow reducing unit and a planetary gear reduction unit.

In the fourth embodiment of FIG. 4, the motor and pump assembly 104 has a planetary gear reduction unit 106 similar in construction to the planetary gear reduction unit 94 of FIG. 3 except that the motor drive shaft 72 is connected to the upstream planetary gear shaft 98 by a coupling 76. Similarly, the downstream planetary gear shaft 100 is connected to the pump drive shaft 78 by another coupling 76. It should be noted that the fluid conduit 88 between the motor element 66 and the pump element 80 does not communicate with the planetary gear reduction unit 106, but is behind gear reduction unit 106 and has a check valve 89. In this system, the motor ring insert 74 and the pump ring insert 86 are equal in size surrounding spaces equal in volume. The motor rotor vanes 68 and the pump rotor vanes 82 are now equal in radius. Therefore, the mechanical advantage is accomplished by incorporating the gear reduction unit 106 into the motor and pump assembly 104. The liquid fluid flow rate has been reduced significantly while the liquid fluid pressure has been significantly increased without the addition of any energy to the system when a higher pressure load is applied. The fluid flow reducing unit remains just a reducer of fluid flow without an applied variable fluid pressure load. In a similar manner for the transmission of mechanical power, an applied variable torque load is required for traction propulsion. The shaft speed of an engine's power output is reduced with a variable torque load.

Figure 5:
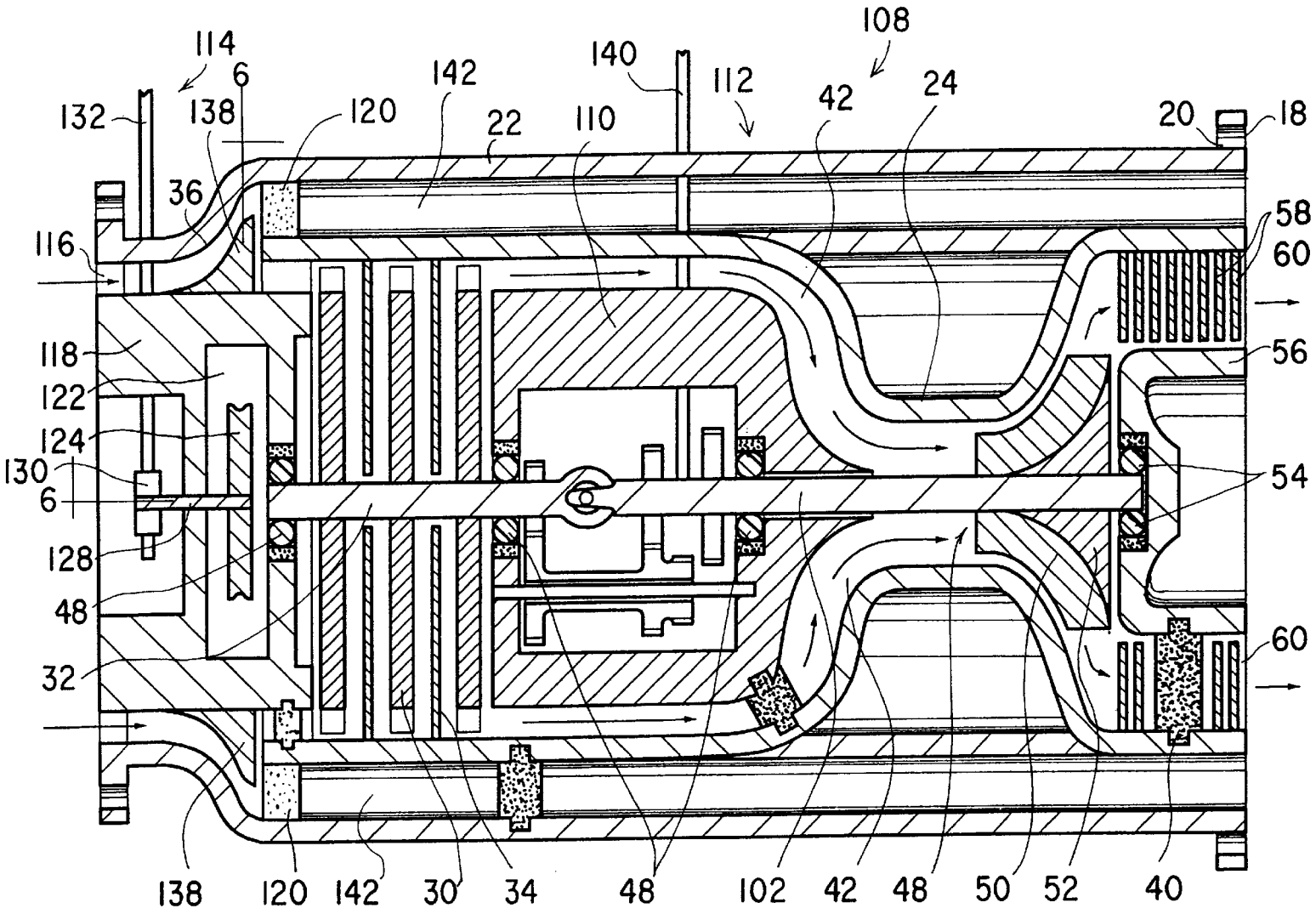
FIG. 5 is a cross-sectional view of a fifth embodiment of a gas turbine and compressor system including a variable gear reduction unit, a by-pass conduit with a ring valve and a fluid flow reducing unit.
Figure 6:
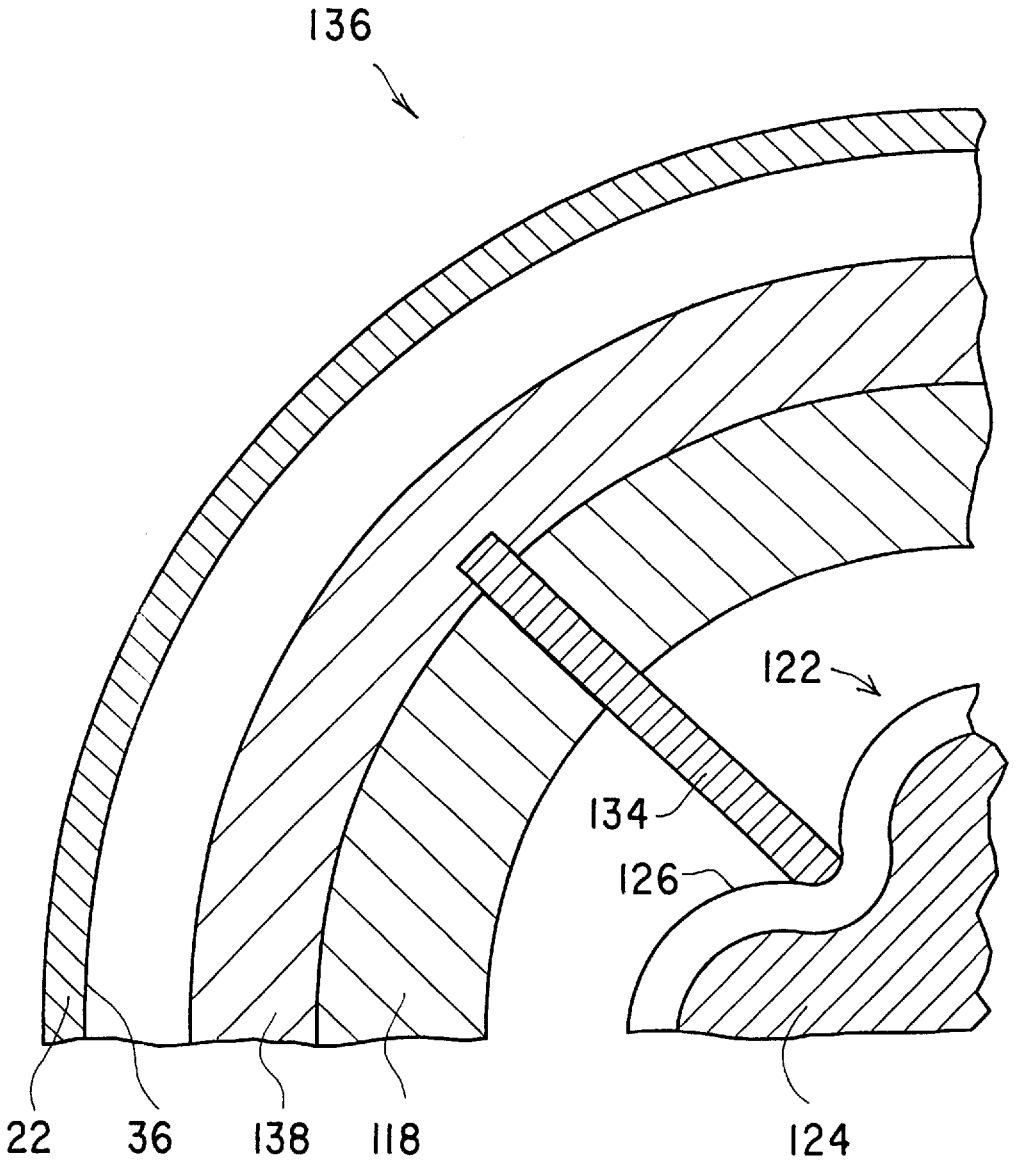
FIG. 6 is a partial detailed cross-sectional view of the fluid by-pass conduit with the ring valve along the quadrant 6—6 in the fifth embodiment gas turbine portion of FIG. 5.

In the fifth embodiment of FIGS. 5 and 6, the turbine and compressor system 108 has a conventional variable gear reduction unit or a mechanical transmission 110 combined with a fluid flow reducer unit 112 and a fluid flow by-pass element 114. A by-pass conduit 116 is provided in the periphery adjacent to the inside surface 36 of the outer cylindrical casing 22. In FIGS. 5 and 6, the by-pass conduit 116 is shown in the open phase.

The inlet support casing 118 is supported by struts 120 which perform a dual function to be explained below. The cylindrical casing 118 has an inner cylindrical chamber 122 which houses a cam 124 with four grooves 126 best seen in the quadrant section of FIG. 6. The cam axle 128 is connected at the opposite end to a transfer gear 130 which is connected to and operated by the ring valve control rod 132. The rod 132 is rotated to cause the cam axle 128 and the cam 124 to rotate and causing the ring valve stem 134 to push each of the four quadrants 136 of the fluid flow selector ring valve 138 from its shown open position in FIGS. 5 and 6 to contact the inside surface 36 of the outer cylindrical casing 22. This closure is implemented by sealing off the four spaces caused by the expansion of the quadrants 136 by the four struts 120 which are positioned across the expansion joints.

The variable gear reduction unit or mechanical transmission 110 is included within the turbine support casing 38 and is manipulated by a conventional gear shift lever 140 which operates the shifting of the gears from outside the casing 22. Turbine drive shaft 32 is linked to the impeller drive shaft 102 within the modified mechanical transmission 110. Bearings 48 support the turbine drive shaft 32 and the impeller drive shaft 102.

When the by-pass conduit 116 is closed, the incoming fluid now courses into the fluid flow channel 142, through the turbine rotor blades 30 and stators 34, the channel 42 with its increasing volume, to the impeller 48 which has been mechanically controlled to reduce its r.p.m., and issues from the fluid outlet 60 with an increased pressure. Therefore, the variable gear reduction unit or mechanical transmission 110 has functioned effectively as a dynamic fluid variable pressure booster.

Figure 7:
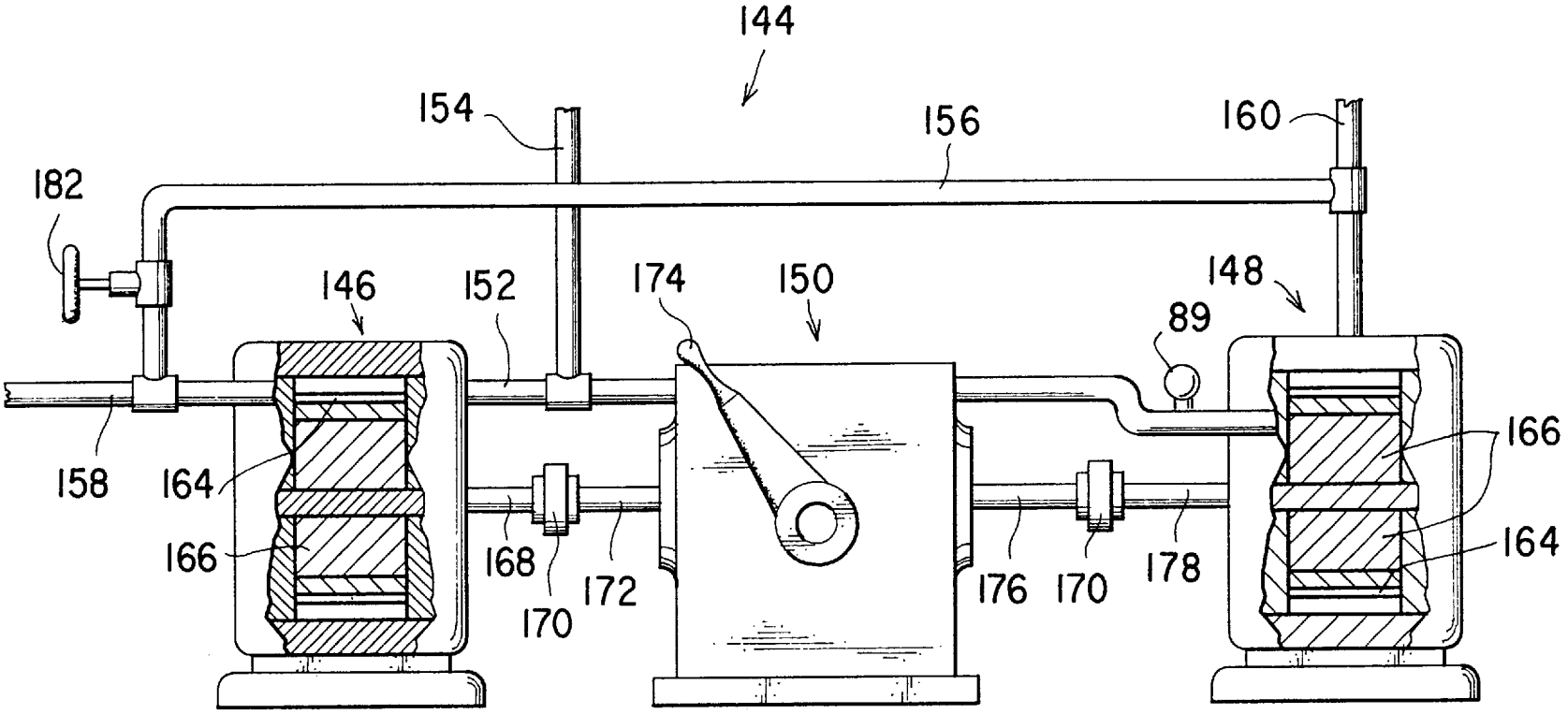
FIG. 7 is a partial cross-sectional view of a sixth embodiment of a motor and pump assembly for liquids including a fluid flows reducing unit, a fluid by-pass conduit, and a variable gear reduction unit.

In the sixth embodiment depicted by FIG. 7, a motor and pump system 144 is shown having a motor 146 and a pump 148 connected by a variable gear or mechanical transmission unit 150, a fluid conduit 152 with a bleed-off conduit 154, and a fluid by-pass conduit 156 connected to the fluid inlet conduit 158 and the fluid outlet conduit 160. As noted for the drawing of FIG. 4, the fluid conduit 152 does not communicate with the variable gear unit 150, but passes behind the unit 150.

The rotor vanes 164, and the rotor bases 166 of the motor 146 and pump 148 are now identical in size without inner rings. The motor drive shaft 168 is connected by a coupling 170 to the input shaft 172 of the variable gear or mechanical transmission unit 150. A gear shift lever 174 controls the variable gears. The output shaft 176 of the variable gear unit 150 is connected by a coupling 170 to the input (drive) shaft 178 of the pump 148.

With the fluid having an entry flow rate and pressure that enters the inlet conduit 158, by-pass valve 182 is closed to permit operation of the motor and pump system 144. When the system 144 is not operating, opening the by-pass valve 182 permits the fluid to circumvent the system. As the fluid is permitted to flow into the motor 146, the fluid rotates the motor rotor vanes 164 projecting from the motor rotor base 166 which is directly connected to the motor drive shaft 168 to produce a rotational shaft speed of the input shaft 172 of the variable gear unit 150. By reducing the rotational speed of the output shaft 184 with the gear shift lever 174, the fluid conduit 152 transports the fluid from the motor 146 to the pump 148. The bleed-off conduit 154 serves to bleed of some fluid if a "positive displacement" fluid motor and a fluid pump are used. The bleed-off fluid can be returned to a fluid source reservoir to be recycled to the fluid inlet conduit 158 (not shown).

The fluid flow at the pump outlet conduit 160 has a variable reduction with respect to the fluid flow at the motor inlet conduit 158. If a fluid flow-pressure load that is variable, is adapted to the motor or pump system 144 or the fluid flow variable reducer; the flow reducer's output fluid pressure may be varied to equal the fluid pressure variable load and also be greater than its input fluid pressure. The fluid flow variable reducer will then function as a dynamic fluid variable pressure booster.

Figure 8:
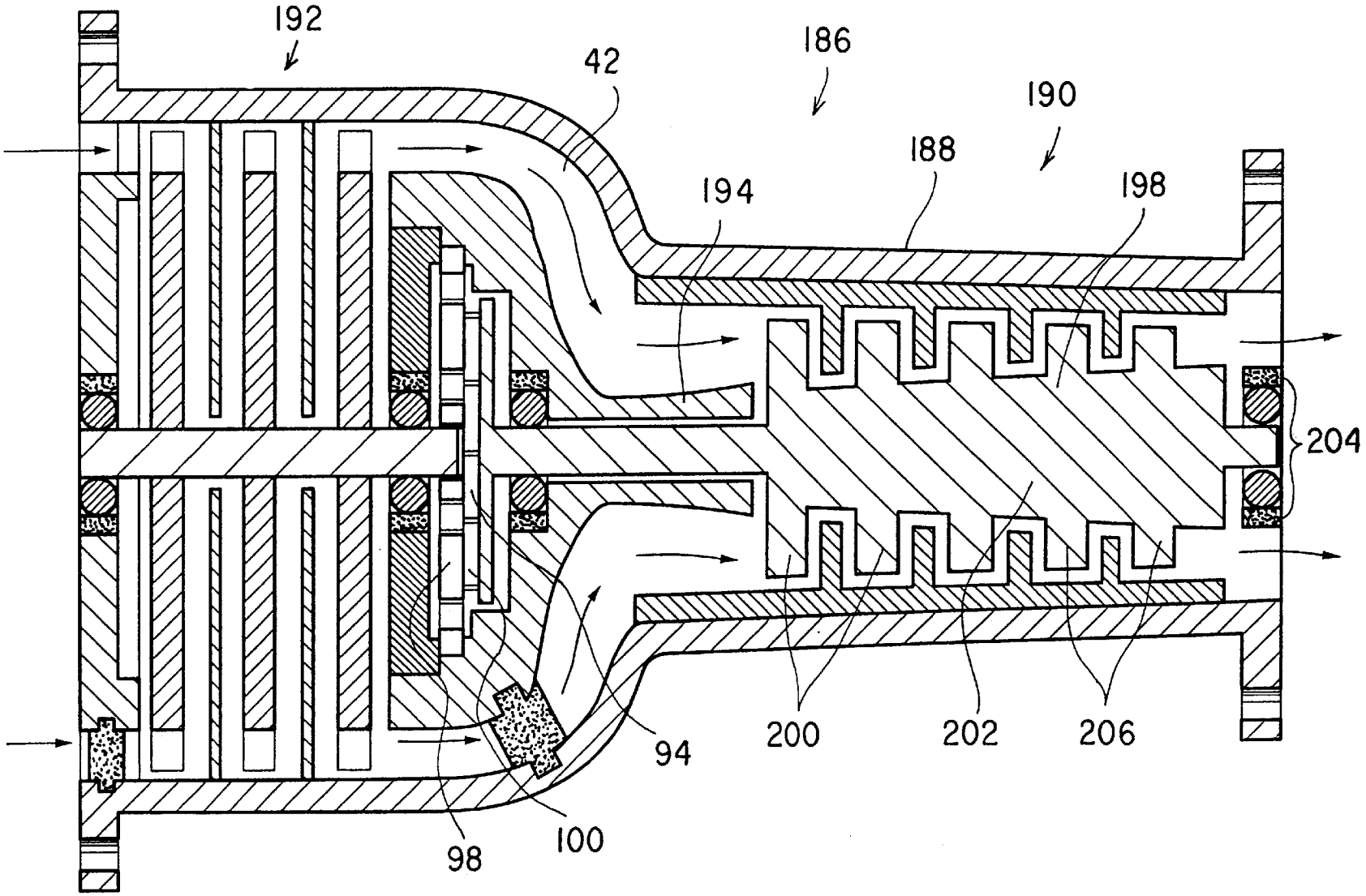
FIG. 8 is a cross-sectional view of a seventh embodiment of a gas turbine and an axial flow compressor system including a gas flow reducer element.

FIG. 8 is drawn to the seventh embodiment of an axial flow compressor for a gas flow reducer element, and is a modification of the FIG. 3 embodiment. The turbine and compressor system 186 has an elongated neck portion 188 without the enlargement in diameter of the compressor portion 190. The turbine portion 192 has been modified only to the extent that the downstream end 194 of the turbine support casing 196 has been elongated to almost abut the elongated impeller 198. The impeller has an axial arrangement of the impeller rotor blades 200 which are supported by a cylindrical base 202 which increases slightly in diameter downstream. The impeller support casing 204 has been reduced to the diameter of the impeller base 202. Supporting struts for the impeller support casing 204 are not shown in this sectional view. The planetary gears 98 and 100 function as in FIG. 3. The channel 42 in the turbine portion 192 increases in volume as in the previous embodiments. The impeller rotor blades 200 are arranged to alternate with the compressor stator blades 206. Although only 10 impeller rotor blades 200 and 8 compressor stator blades 206 are illustrated, it is contemplated that more blades in the compressor portion 190 can be utilized. In this embodiment, the mechanical advantage for the turbine and compressor system 186 is attained by the increase in channel volume in the turbine channel 42, the reduction in rotation of the compressor portion by the planetary gear reduction unit 94, and the axial flow of the elongated impeller 198 in the compressor portion 190.

It should be noted that unnecessary vibration in the mechanical systems of the present invention should be avoided by careful alignment and balancing of the components in the present invention. It is further noted that it will be necessary to provide sufficient strength of a material coverage around the compressor to contain the increased gas pressure when a higher pressure load is applied.

It is to be understood that the present invention is not limited to the embodiments described above, but encompasses any and all embodiments within the scope of the following claims.

I claim:

1. A fluid flow reducing unit for a turbine and compressor system comprising:

a necked down portion between a turbine portion leading to a compressor portion in a turbine and compressor system;

a peripheral channel increasing in volume from the turbine portion to the necked-down portion;

a fluid flow reducing unit comprising a mechanical gear reduction unit contained within the turbine portion and operatively connected to an impeller of the compressor portion; and said impeller having a diameter less than the diameter of the turbine portion;

whereby the influent fluid having a predetermined flow and pressure can be reduced in flow and increased in pressure in the effluent fluid without the addition of energy to the turbine and compressor system by a mechanical advantage.

2. A fluid flow reducing unit for a motor and pump system comprising:

a motor element comprising rotor blades of a first diameter confined in a chamber limited by a motor element ring having a first inner diameter, said rotor blades positioned on a motor rotor base having an axle;

a pump element comprising rotor blades of a second diameter, said second diameter being significantly less than said first diameter of said motor element rotor blades and confined in a chamber limited by a pump element ring having a second inner diameter, said second inner diameter being significantly less than said first inner diameter of said motor element ring, said pump rotor blades positioned on a pump rotor base having an axle which is operatively connected to said axle of the motor element; and a fluid conduit connecting the motor element chamber to the pump element chamber and having a bleed-off conduit and a pressure check valve; whereby a fluid volume in the pump element varies inversely with that of the fluid volume in the motor element by a mechanical advantage, resulting in a reduced fluid flow and increased fluid pressure.

3. A fluid flow reducing unit for a motor and pump system with a gear reduction unit comprising:

a motor element comprising rotor blades of a first diameter confined in a chamber limited by a motor element ring having a first inner diameter, said rotor blades positioned on a motor rotor base having an axle;

a pump element comprising rotor blades of a second diameter, said second diameter equal to said first diameter of said motor element rotor blades and confined in a chamber limited by a pump element ring having a second inner diameter, said second inner diameter being equal to said first inner diameter of said motor element ring, said pump rotor blades positioned on a pump rotor base having an axle;

a gear reduction unit selected from a fixed gear transmission and a variable gear transmission is coupled between the axles of the motor element and the pump element; and a fluid conduit connecting the motor element chamber to the pump element chamber and having a bleed-off conduit and a pressure check-valve; whereby a fluid volume in the pump element varies inversely with that of the fluid volume in the motor element by a mechanical advantage, resulting in a reduced fluid flow and increased fluid pressure without the addition of energy when a fluid pressure load is applied.

4. The fluid flow reducing unit of claim 3, wherein the gear reduction unit is a fixed gear transmission.

5. The fluid flow reducing unit of claim 3, wherein the gear reduction unit is a variable gear transmission having a gear shift lever.

6. A fluid flow reducing unit for a turbine and compressor system comprising:

a turbine portion and a compressor portion of a turbine and compressor system having an asymmetrical cylindrical outer casing, wherein the compressor portion has a significantly smaller diameter;

the turbine portion comprises a rotor base supporting turbine rotor blades, said rotor base having an axle operatively connected to a planetary gear reduction unit which is confined in a turbine support casing;

said turbine support casing and the cylindrical outer casing defining a channel which increases in volume from the turbine portion to the compressor portion;

the compressor portion containing an elongated impeller comprising a rotor base of increasing diameter supporting rotor blades of decreasing radius downstream;

said compressor rotor base having an axle operatively connected to the planetary gear reduction unit;

said outer casing supporting stator blades in the turbine portion and in the compressor portion which alternate with the rotor blades of the turbine portion and the compressor portion;

whereby an influent fluid has its volume flow reduced and its pressure increased by a mechanical advantage without the addition of energy when a higher fluid pressure load is applied.

* * * * *